United States Patent [19]

Nagai et al.

[11] 4,136,299

[45] Jan. 23, 1979

[54] LIGHTNING ARRESTER DEVICE

[75] Inventors: Nobuo Nagai, Nishinomiya; Tugio Watanabe, Akoh; Shoji Tada, Itami, all of Japan

[73] Assignee: Mitsubishi Denki Kabushiki Kaisha, Japan

[21] Appl. No.: 680,368

[22] Filed: Apr. 26, 1976

[51] Int. Cl.[2] ..... H01J 17/00; H01J 21/00

[52] U.S. Cl. ..... 313/325; 313/231.1; 315/36; 361/120; 361/123

[58] Field of Search ..... 313/325, 231.1, 231.2, 313/231.2; 361/120, 123, 134; 315/35, 36, 59

[56] References Cited

U.S. PATENT DOCUMENTS

| | | | |
|---|---|---|---|
| 2,987,642 | 6/1961 | Yonkers | 313/231.2 |
| 3,151,274 | 9/1964 | Snell, Jr. | 313/325 X |
| 3,519,878 | 7/1970 | McStrack et al. | 313/325 X |
| 3,588,578 | 6/1971 | Clinkenbeard | 313/325 |
| 3,624,450 | 11/1971 | Graybill | 361/120 |
| 3,649,875 | 3/1972 | Nagai et al. | 315/36 |
| 3,753,045 | 8/1973 | Osmundsen et al. | 315/36 |
| 3,842,318 | 10/1974 | Nitta | 315/36 |

*Primary Examiner*—Saxfield Chatmon, Jr.
*Attorney, Agent, or Firm*—Robert E. Burns; Emmanuel J. Lobato; Bruce L. Adams

[57] ABSTRACT

A grounded cylindrical metallic housing is hermetically closed at one end and an electric insulation hermetically extends through the other closed end of the housing to form in the housing a space filled with an electrically insulating gas. An arrester element disposed in the space has the incoming-line side connected to a terminal extended and sealed through the insulation and the ground side electrically connected to the housing. The incoming-line side of the arrester element is surrounded by both the insulation and a shield ring embedded therein.

42 Claims, 10 Drawing Figures

FIG. 1
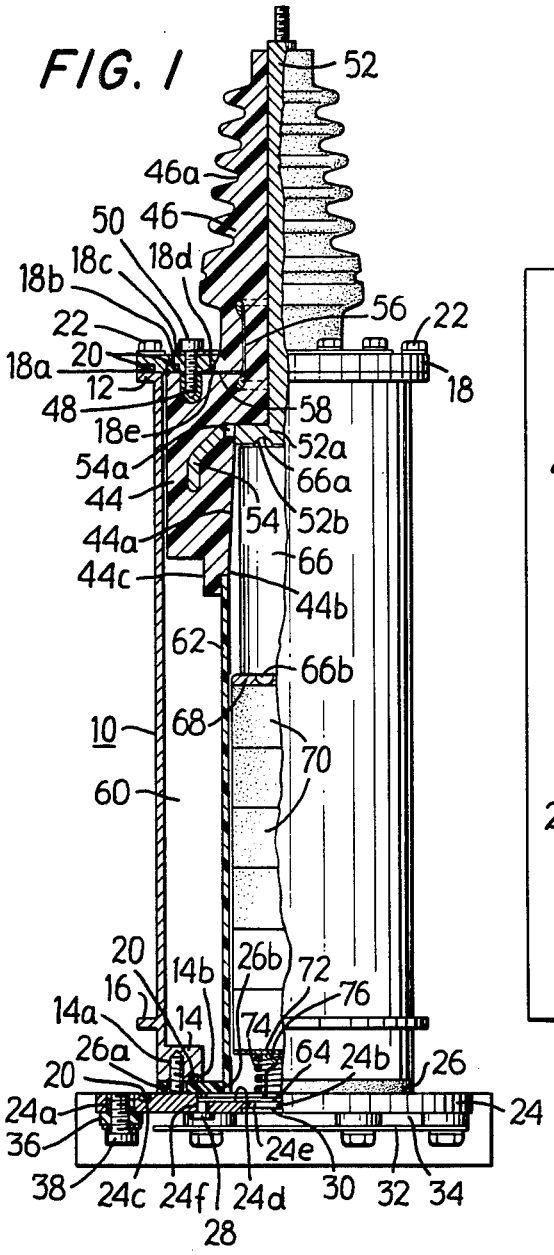
FIG. 2
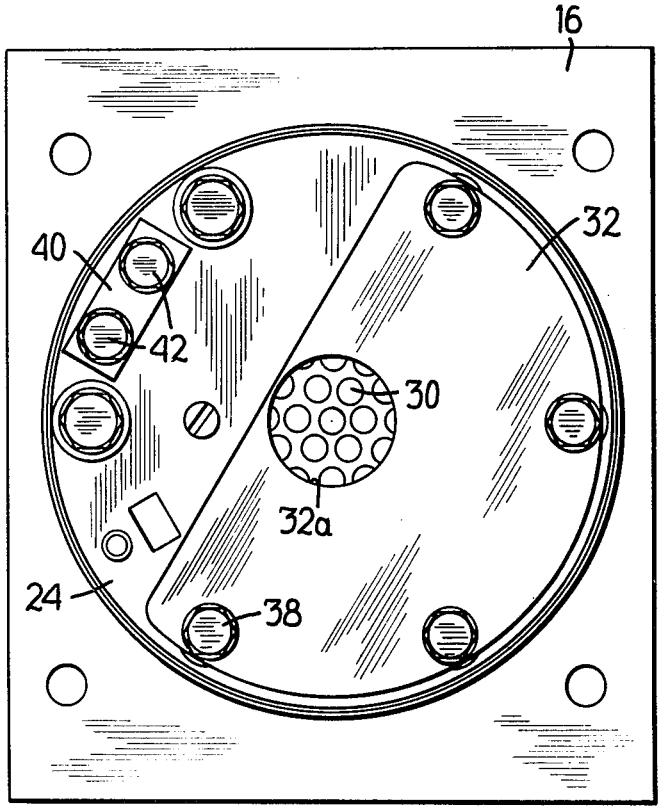
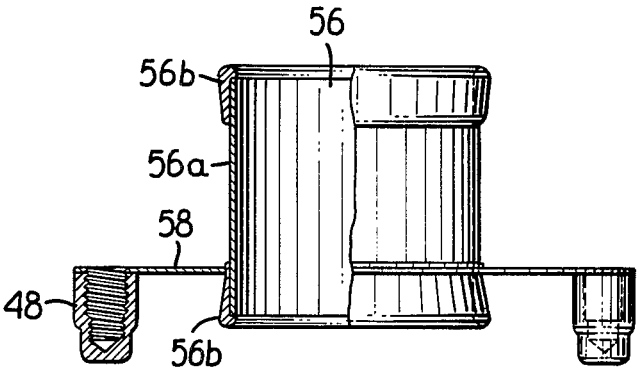
FIG. 3

LIGHTNING ARRESTER DEVICE

BACKGROUND OF THE INVENTION

This invention relates to improvements in a lightning arrester device.

Conventional lightning arrester devices have generally comprised the electrically insulating housing having disposed therein the arrester element and accommodated within the metallic container connected to ground. Therefore they have been relatively large in overall dimension.

Accordingly it is an object of the present invention to provide a new and improved lightning arrester device compact and small-sized, without the discharge characteristics changed from those provided by conventional lightning arrester devices and without any corona discharge developed therein.

It is another object of the present invention to provide a new and improved lightning arrester device of the type as described in the preceding paragraph controllable in discharge characteristics after the assembling operation has been completed.

It is still another object of the present invention to provide a new and improved lightning arrester device of the type as described in the preceding paragraph capable of being easily installed to the line conductor of electric systems.

SUMMARY OF THE INVENTION

The present invention provides a lightning arrester device comprising, in combination, a metallic housing, an arrester element disposed within the metallic housing, an electric insulation block disposed on the incoming-line side of the metallic housing to encircle the incoming-line side of the arrester element while forming a space between the metallic housing and the arrester element to encircle the ground side of the arrester element, terminal means on the incoming-line side of the device extended and sealed through the electrically insulation block to be connected to the incoming-side of the arrester element, and means for forming a hermetic seal between the electric insulation block and the metallic housing, the above-mentioned space providing an electrically insulating space in which the arrester element is disposed.

Preferably, that end surface of the electric insulation block exposed to the electrically insulating space may be radially inwardly tilted with respect to the longitudinal axis of the arrester element.

In order to control the discharge characteristics, a plurality of metallic annuli may be embedded in spaced relationship in the electric insulation block and adjacent to the incoming-line side of the arrester element and selectively connected to the terminal means on the incoming-line side.

The terminal means on the incoming-line side may be formed of at least two flexible, electrical conductors including those portions curved away from each other within the electric insulation block and having bent end portions serving to hang the device on the line conductor of electric systems.

BRIEF DESCRIPTION OF THE DRAWINGS

The present invention will become more readily apparent from the following detailed description taken in conjunction with the accompanying drawings in which:

FIG. 1 is a longitudinal sectional view of one half of a lightning arrester device constructed in accordance with the principles of the present invention with the other half thereof illustrated in its external appearance;

FIG. 2 is a bottom plan view of the arrangement shown in FIG. 1;

FIG. 3 is a longitudinal sectional view of one half of the shield unit shown in FIG. 1 with the other half thereof illustrated in elevation;

Throughout the Figures like reference numerals designate the identical or similar components.

DESCRIPTION OF THE PREFERRED EMBODIMENTS

Figure 4:
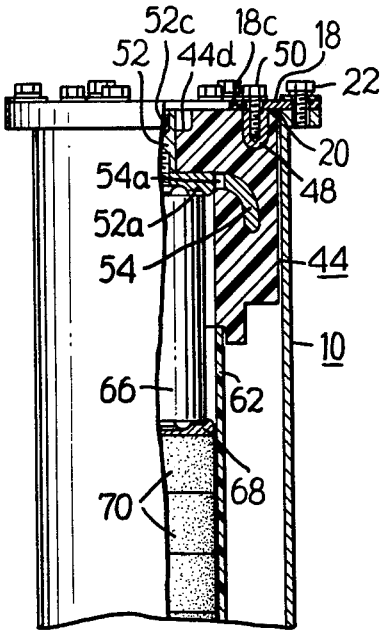
FIG. 4 is a fragmental longitudinal sectional view of one half of the essential portion of a modification of the present invention with the other half thereof illustrated in elevation.

Referring now to the drawings and FIG. 1 in particular, there is illustrated a lightning arrester device constructed in accordance with the principles of the present invention. Only the left half of the device has been shown in longitudinal section because the right half thereof is identical to and symmetrical about the longitudinal axis of the device to the left half. The arrangement illustrated comprises a cylindrical housing of any suitable metallic material such as iron, aluminum or the like generally designated by the reference numeral 10, open at both ends and including a radially outward directed annular flange 12 disposed at the upper open end as viewed in FIG. 1 and a radially inward directed annular flange 14 disposed at the lower open end as viewed in FIG. 1 of the housing 10. The lower annular flange 14 has disposed on the lower surface as viewed in FIG. 1 a plurality, in this case six, of screw threaded holes **14*a* at equal angular intervals and an annular groove 14*b* inside of the holes 14*a* and concentric with the housing 10. The housing 10 is provided on the lower portion of the outer peripheral wall with a radially outwardly directed annular flange 16** shown in FIG. 2 as being of a square profile and serving to suitably connect the housing to ground.

The upper open end of the housing 10 is closed with an upper cover plate 18 in the form of an apertured metallic disc provided on the lower surface as viewed in FIG. 1 with a pair of annular grooves **18*a* and 18*b* concentric with the housing 10 and having a plurality of small holes 18*c* (only one of which is illustrated) extending therethrough in a circle located inside of the inner groove 18*b* and having the center on the longitudinal axis of the housing 10. The upper cover plate 18 further includes a central large aperture 18*d* having a radially inwardly convex surface 18*e* merged into the lower surface thereof adjacent to the small holes 18*c*. The upper cover plate 18 is hermetically fastened to the upper end of the housing 10 by having seal packings such as O-rings 20 disposed in the grooves 18*a* and 18*b* and a plurality of bolts 22 extending therethrough to be screw threaded into the annular flange 12**.

The lower open end of the housing 10 is closed with a lower cover plate 24 in the form of an apertured metallic disc through an apertured disc 26 of any suitable electrically insulating material. To this end, the lower cover plate 24 and the insulating disc 26 are provided on the outer peripheral portions with a plurality, in this case six, of pairs of aligned small holes 24*a* and 26*a* respectively (only one pair of which are illustrated) adapted to be substantially aligned with the screw threaded holes 14*a* on the lower flange 14 of the housing 10. The lower cover plate 24 and the insulating disc 26 include respective central apertures 24*b* and 26*b* with the aperture 24*b* smaller in radius than the aperture 26*b*. In FIG. 1 it is to be noted that the lower cover plate 24 and associated components are somewhat exggerated only for purposes of illustration.

The lower cover plate 24 has disposed on the upper surface thereof as viewed in FIG. 1 an annular groove 24*c* substantially opposing to the annular groove 14*b* on the lower housing flange 14 and an annular recess 24*d* having an outside diameter greater than the diameter of the central aperture 26*b* on the insulating disc 26 and also on the opposite or lower surface thereof an annular recess 24*e* concentric with but smaller in outside diameter than the annular recess 24*d*. Then a single screw threaded hole 24*f* extends through the cover plate 24 at such a position that the open end thereof intersects the outer periphery of the annular recess 24*d* on the upper cover surface. A seal screw 28 is adapted to be screw threaded into the hole 24*f* for the purpose as will be apparent hereinafter.

The recess 24*e* on the lower surface of the lower cover plate 24 has a bursting sheet or a pressure relief diaphragm 30 of the well known construction hermetically fitted thereinto only by soldering thereby to close the central aperture 24*b* on the lower cover plate 24. Then the lower cover plate 24 opposes a protective plate 32 across a gap 34 as determined by heads of flanged sleeves 36 snuggly fitted into the aligned holes 24*a* and 26*a* on the superposed cover plate and insulating disc 24 and 26 respectively. Fastening bolts 38 extend through the respective sleeves 36 to be screw threaded into the threaded holes 14*a* on the lower housing flange 14 thereby to hermetically fasten the lower cover plate 24 and the insulating disc 26 to the housing 10 along with the protective plate 32 while seal packings 20 such as O-rings are inserted into the grooves 14*b* and 24*c*.

As best shown in FIG. 2, the protective plate 32 is in the form of a circular segment having an aperture 32*a* having the center lying on the longitudinal axis of the housing 10. The cover plate 24 is provided on that portion not over laid by the protective plate 32 with a clamping terminal 40 fixedly secured thereto through a pair of bolts 42.

As shown in FIG. 1, an electric insulation block generally designated by the reference numeral 44 of any suitable electrically insulating material such as epoxy resin includes a lower portion disposed within the housing 10 in the upper portion or on the incoming-line side thereof, an intermediate portion extending through the opening 18*d* on the upper cover plate 18 to intimately contact the curved peripheral surface 18*e* of the opening 18*d*, and an upper portion protruding beyond the upper cover plate 18 to form a bushing portion 46.

The lower portion of the insulation block 44 has an upper annular flat surface abutting against the adjacent portion of the lower surface of the upper cover plate 18 and including a female screw members 48 embedded thereinto so as to face the small holes 18*c* on the upper cover plate 18. The lower block portion includes a central circular opening 44*a* coaxial with the longitudinal axis of the housing 10 and having a peripheral wall surface somewhat flared toward the lower end. An annular step 44*b* is disposed on the peripheral wall surface of the opening 44*a* adjacent the lower end for the purpose as will be apparent hereinafter. The lower block portion has an outside diameter slightly smaller than the inside diameter of the housing 10 except for the lower end portion being radially inwardly cut to form an annular step 44*c* larger and nearer to the upper end of the housing 10 than the annular step 44*b* on the peripheral wall surface of the opening 44*a*.

The bushing portion 46 includes a plurality of circumferential grooves 46*a* disposed in axially spaced, parallel relationship on the peripheral wall thereof the lowest one of which is shallower than the remaining grooves.

A terminal rod 52 of any suitable electrically conductive material on the incoming-line side is extended and sealed through the electrically insulation block 44 along the longitudinal axis thereof and has a lower terminal plate 52*a* integral therewith and provided on the lower surface as viewed in FIG. 1 with a circular recess 52*b*. The terminal plate 52*a* is located in the opening 44*a* to define the upper end surface thereof. The terminal rod 52 has its upper portion slightly extended from the upper end thereof and screw threaded for the purpose as will be apparent later.

Embedded into the lower portion of the electric insulation block 44 is an annular shield member 54 of any suitable, electrically conductive material such as aluminum generally radially outwardly and downwardly extending from the periphery of the terminal plate 52*a* and including an annular extension directed toward the lower side or the ground side of the housing 10 to be coaxial with the longitudinal axis thereof. The annular shield member 54 has a plurality of small holes 54*a* (only one of which is illustrated) disposed at angularly equal intervals and close to the terminal plate 52*a*, for the purpose as will be apparent hereinafter. The shield member 54 serves to decrease or alleviate an electric field established about the terminal plate 52*a* within the electric insulation block 44.

Since the terminal rod 52 and the shield member 54 are embedded into the insulation block 44, the former two are preferably formed of a material approximating in coefficient of thermal expansion the material of the insulation block 44. For this reason the terminal rod 52 and the shield member 54 is preferably formed of aluminum with the insulation block 44 made of epoxy resin.

As shown in FIG. 1, another metallic shield member 56 is embedded in that portion of the insulation block 44 located adjacent to the upper cover plate 14 and around the terminal rod 52. As best shown in FIG. 3, the shield member 56 is composed of a hollow metallic cylinder 56*a* coaxial with the longitudinal axis of the housing 10 and a pair of annular semiconductor electrodes 56*b* attached to both end portions of the cylinder 56*a*. Then the shield member 56 is fitted into and supported by an annular support sheet 58 subsequently fixedly secured to the female screw members 48 as by soldering. The shield member 56 also serves to decrease or alleviate an electric field established in that portion of the electric insulation block 44 adjacent to the upper cover plate 18.

The electric insulation block 44 can be produced by moulding any suitable electrically insulating resinous material such as epoxy resin within a mold having the desired configuration and the female screw member 48, the terminal rod 52, the terminal plate 52*a* and the shield members 54 and 56 preliminarily positioned in place therein. Upon this molding the small holes 54*a* and in uniformly filling the mold with the resinous material.

The electric insulation block 44 disposed in the manner as above described leaves a space 60 within the housing 10 between the same and the electrically insulating plate 26 underlaid by the lower cover plate 24. The space 60 is adapted to be filled with an electricaly negative gas, for example, nitrogen ($N_2$), sulfur hexafluoride ($SF_6$) or the like to provide an electrically insulating space.

A hollow cylindrical member 62 of any suitable electrically insulating material such as epoxy resin, MICARTA (trade mark) or the like is positioned in the electrically insulating space 60 by having its upper end abutting against the inner annular step 44*b* of the opening 44*a* and its lower end abutting against the annular recess 24*d* on the lower cover plate 24 through a metallic adjustment sheet or sheets 64 disposed in the recess 24*d*. The hollow cylindrical member 62 is coaxial with the cylindrical housing 10 and forms an inner cylindrical space with the central opening 44*a* in the insulation block 44.

Within that inner insulating space a discharge gap device 66 including a plurality of discharge gaps (not shown) serially interconnected is disposed in place by having an annular ridge 66*a* on the upper end surface thereof abutting against the annular recess 52*b* on the terminal plate 52*a* and another annular ridge 66*b* on the lower end surface thereof contacting a holding metallic disc 68 complementary in configuration to the lower end surface of the discharge gap device 66. Then the holding plate or disc 68 is disposed upon a stack of axially superposed characteristic elements 70 subsequently resiliently carried by the lower cover plate 24 through a metallic sheet 72 and a compression spring 74 disposed between the metallic sheet 64 disposed on the annular recess 24*d* on the lower cover plate 24 and the lower end of the stack 70. The discharge gap device 66 and the stack of superposed characteristic elements 70 are of the well known construction and form a lightning arrester element. The metallic sheet 72 is electrically connected to the metallic adjustment sheet 64 through a flexible lead 76.

In the arrangement of FIG. 1 it is seen that about two-thirds of the height of the discharge gap device 66 is encircled by the lower portion of the electrically insulation block 44 while the incoming-line side thereof is surrounded by the metallic shield member 54.

The arrangement thus far described is evacuated through the threaded hole 24*f* on the lower cover plate 14 and then filled with any suitable electrically negative gas such as sulfur hexafluoride after which the seal screw 28 is screw threaded into the hole 24*f* followed by the soldering of the seal screw 28 to the lower cover plate 24.

The arrangement of FIG. 1 is put in its operative state by having the exposed portion of the terminal rod 52 electrically connected to a line conductor of the particular electric system and the housing 10 suitably connected to ground. Under these circumstances, the application of an impulsive voltage to the arrangement of FIG. 1 caused from any electric surge results in the uniform application of the voltage across the discharge gas device 66 in its entirety. This is because the tendency for the resulting electric field to be otherwise concentrated on the upper portion of the discharge gap device 66 due to a stray capacitance involved is cancelled out by the behavior of the electric field wherein it is caused to be concentrated toward the insulation space 60 filled with an electrically negative gas very much lower in dielectric constant than the material of the insulation block 44. Also the alleviation or moderation of the field concentration is effective for preventing the occurrence of corona discharges in the arrangement of FIG. 1 even though the latter is small-sized while the discharge characteristics remain unchanged.

The interface between the electric insulation block 44 and the insulation space 60 is step-shaped due to the presence of the step 44*c* so that a stray capacitance between the grounded housing 10 and the discharge gap device 66 is substantially continuously changed from the upper to the lower end of the discharge gap device 66. Thus any impulsive voltage applied across the lightning arrester device results in a voltage more uniformly impressed across all the discharge gaps of the device 66.

The impulsive voltage then discharges across all the discharge gaps of the device 66 until the voltage is entirely applied across the stack of characteristic elements 70. Under these circumstances, the step-shaped interface between the electric insulation block 44 and the electrically insulating space 60 cooperates with a difference in dielectric constant between the material of the insulation block 44 and the gap filling the space 60 to prevent the particular electric field from being concentrated on the periphery of the discharge gap device 66 but to concentrate toward the radial direction of the device 66. As a result, the electric field around the arrester elements or the discharge gaps and characteristic elements is alleviated or moderated until a substantially uniform electric field is established along the surface of the electric insulation block 66 resulting in an increase in creep dielectric strength of that surface. Also the resulting equipotential lines have less of a tendency to establish a non-uniform electric field on the surface of the electric insulation block 44. This permits also the prevention of the occurrence of a corona discharge.

The results as above described will readily be understood from the physical property that electric fields are more concentrated in electrically insulating gases than in electrically insulating solid materials.

Since the shield members 54 and 56 are fully embedded into the electric insulation block 44, withstanding voltages required between the same and the grounded housing 10 can be increased to decrease distances therebetween. Even with either one of the shield members 54 and 56 including a small protrusion on the surface thereof, the electric insulation block 44 is effective for preventing either a corona discharge from occurring on the protrusion or a flashover from being facilitated to take place on the protrusion.

Therefore the design of each of the shield members 54 and 56 increases in flexibility so that the discharge characteristics of the lightning arrester device can very readily be controlled within a broad range as by changing the extremity portion of the shield member 54 without the necessity of increasing the dimension of the housing. In addition, if the arrester device vibrates for some reason, the use of electric insulation block 44 prevents the shield member 54 from contacting or approaching the grounded housing 10. This eliminates a cause for a flashover across the two.

Referring now to FIG. 4, there is illustrated a modification of the present invention wherein the bushing portion 46 and the shield member 56 as shown in FIG. 1 are omitted. In the arrangement illustrated the electric insulation block 44 terminals at the level of the lower or inner surface of the upper cover plate 18 and has a central recess 44*d* disposed on the upper end surface. The terminal rod 52 centrally projects into the central recess 44*d* on the electric insulation block 44 to be substantially flush with the upper surface of the latter and is provided on the projecting end portion with a threaded hole 52*c*. A seal packing 20 such as an O-ring is disposed at the outer bevelled periphery of the upper surface of the insulation block 44 to permit the upper cover plate 18 without their annular grooves 18*a* and 18*b* to hermetically close the upper end of the housing 10.

In other respects the arrangement is identical to that shown in FIG. 1.

Figure 5:
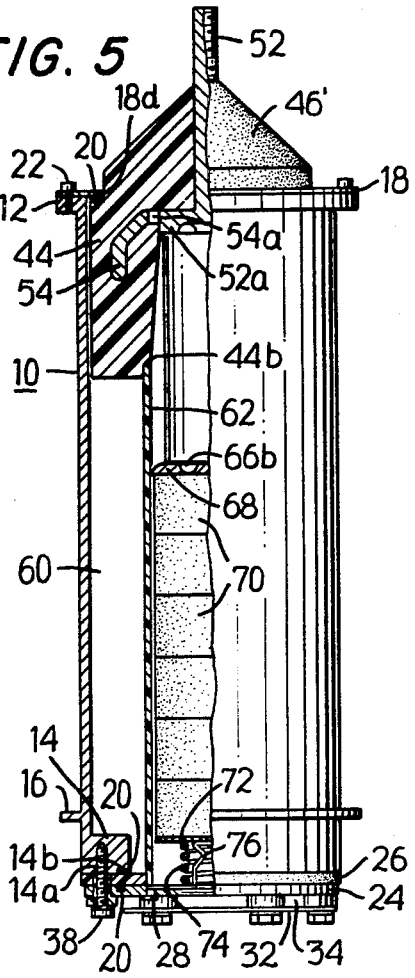
FIGS. 5 through 8 are views similar to FIG. 1 but illustrating different modifications of the present invention.

FIG. 5 shows another modification of the present invention wherein the electric insulation block is simplified in configuration as compared with the electric insulation block 44 as shown in FIG. 1. More specifically, the electric insulation block 44 includes the lower annular surface substantially normal to the longitudinal axis of the housing 10 and that portion thereof extending in the form of a substantially truncated cone 46' from the central opening 18*d* on the upper cover plate 18. Further that annular surface of the electric insulation block 44 intimately contacting the inner surface of the upper cover plate 18 is provided at the outer periphery with an annular bevelled facelet having resting thereon a seal packing such as an O-ring 20 as above described in conjunction with FIG. 4. The annular grooves 18*a* and 18*b* on the upper cover plate 18 and the associated O-rings 20 are omitted and also the shield member 56, the female screw members 48 and the fastening screws 50 are omitted. In other respects the arrangement is identical to that shown in FIG. 1.

Figure 6:
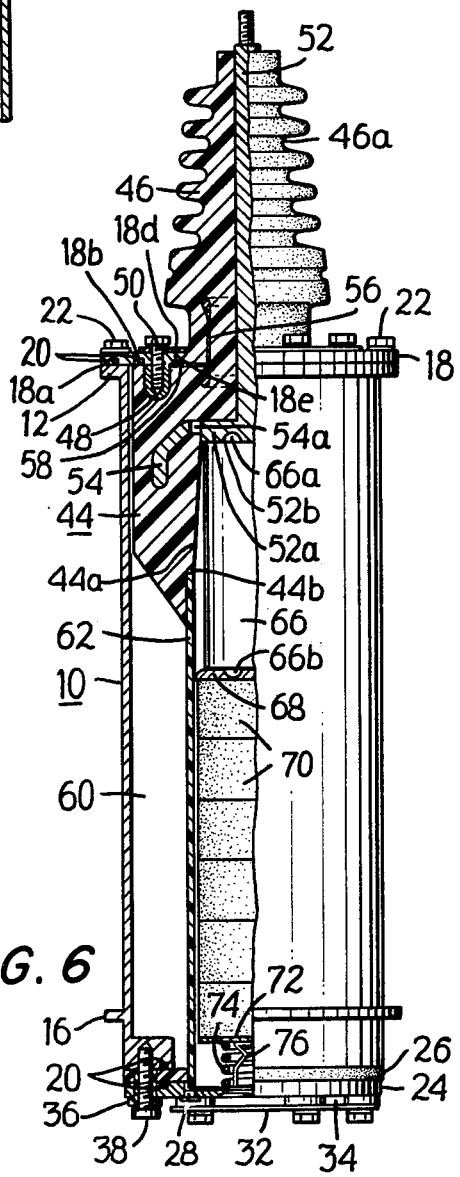
Figure 7:
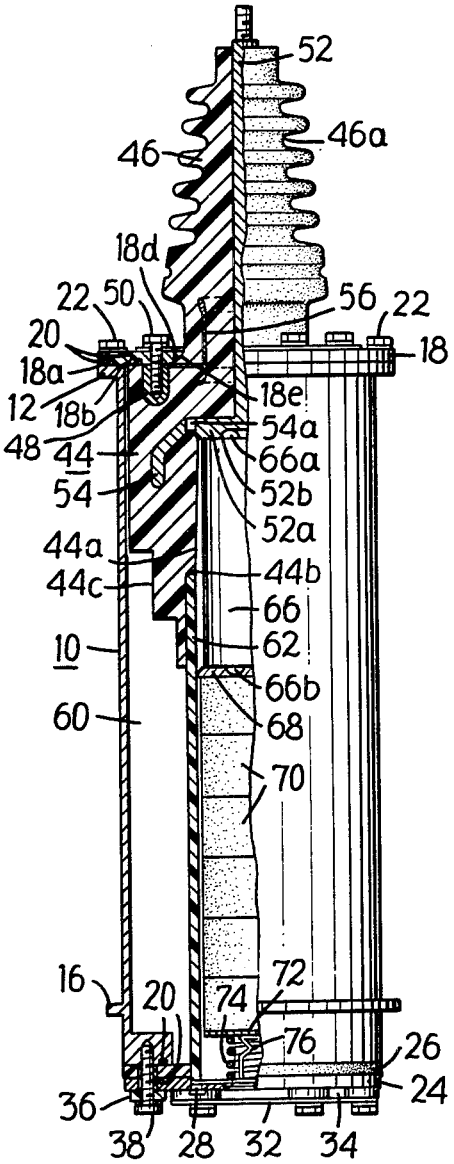

Arrangements illustrated in FIGS. 6 and 7 are different from the arrangement shown in FIG. 1 only in the configuration of the lower end surface of the electric insulation block 44. Namely FIG. 6 illustrates the electric insulation block 44 including the lower end surface tilted inwardly in the radial direction of the longitudinal axis of the housing 12 while FIG. 7 illustrates the electric insulation block 44 including the lower end surface provided with a plurality, in this case, two of the annular steps, 44*c*.

Figure 8:
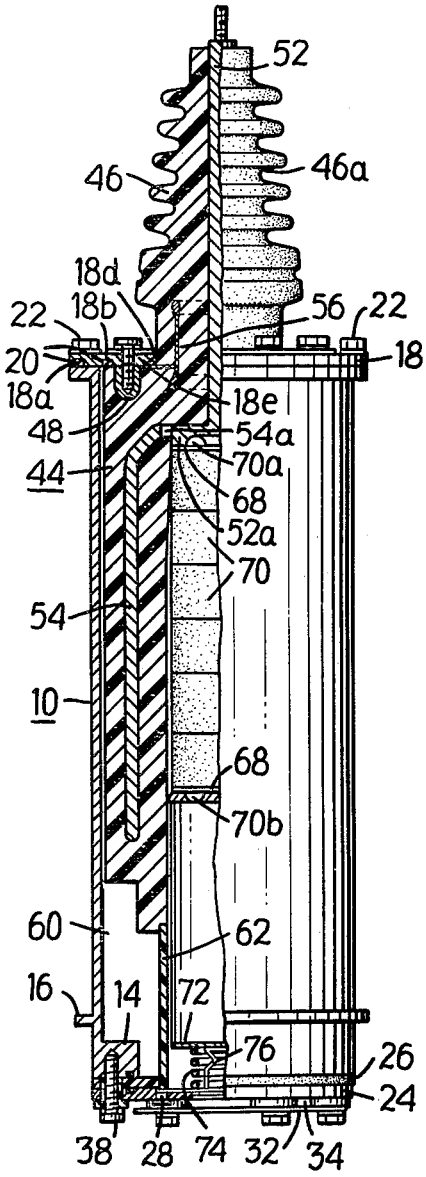

In an arrangement as shown in FIG. 8 the stack of characteristic elements 70 is disposed upon the discharge gap device 66 through the holding plate 68 by having a pair of annular ridges 70*a* and 70*b* disposed on the upper and lower surfaces thereof and engaging the terminal and holding plates 32*a* and 68 respectively. In other words, the stack of characteristic elements 70 is located on the incoming-line side and the discharge gap device 68 is located on the ground side of the arrester device. Then the electric insulation block 44 extends toward the lower cover plate 24 to encircle the stack of characteristic elements 70 until the lower end portion thereof similar on configuration to that shown in FIG. 1 terminates adjacent the axial middle of the discharge gap device 68. Also the annular shield member 54 extends toward the ground side to encircle the stack of characteristic elements 70 and the upper portion of the discharge gap device 68.

In other respects the arrangement is identical to that shown in FIG. 1.

Figure 9:
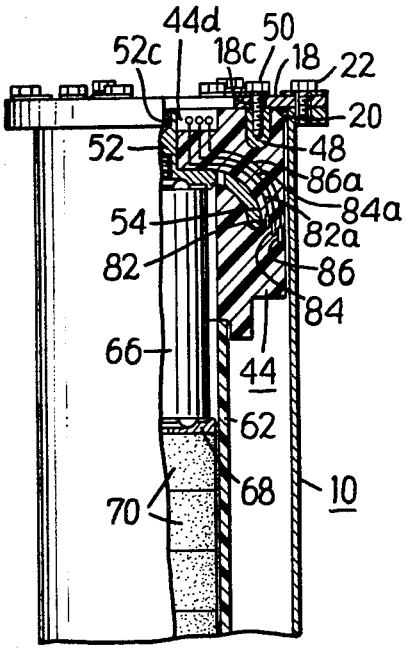
FIG. 9 is a view similar to FIG. 4 but illustrating a separate modification of the present invention.

An arrangement as illustrated in FIG. 9 is substantially identical to that shown in FIG. 4 excepting that a plurality, in this case, three of electrodes 82, 84, and 86 in the form of rings are embedded in the electric insulation block 44 and adjacent to the end portion of the annular shield member 54 to be concentric with the discharge gap device 68. The electrode 82, 84 and 86 are located at different levels so that the innermost electrode 72 is higher than the intermediate electrode 84 subsequently higher than the outermost electrode 76 with respect to the position relative to the lower end of the electric insulation block 44.

Then the electrodes 82, 84 and 86 are connected to one end of respective leads 82*a*, 84*a* and 86*a* having the other ends extending into the central recess 44*d*, and adjacent to the terminal rod 52 on the incoming-line side. A selected one or ones of the leads 82*a*, 84*a* and 86*a* can be electrically connected to the terminal rod 52.

With the leads 82*a*, 84*a* and 86*a* maintained electrically insulated from the incoming-line terminal rod 52, a potential profile around the annular shield member 54 remains substantially unchanged from that existing without the electrodes 82, 84 and 86. When any one or more of the leads 82*a*, 84*a* and 86*a* is or are connected to the incoming-line terminal rod 52, this resembles an increase in diameter of the annular shield member 54. Thus the potential profile in changed. This permits the discharge characteristics of the discharge gap device 66 to be controlled as desired after the molding of the electric insulation block 42. Therefore the arrangement of FIG. 9 according to the present invention provides lightning arrester devices substantially uniform in discharge characteristics. In other words, molded lightning arrester devices according to the present invention can be put to practical use which has been previously regarded as being difficult.

Figure 10:
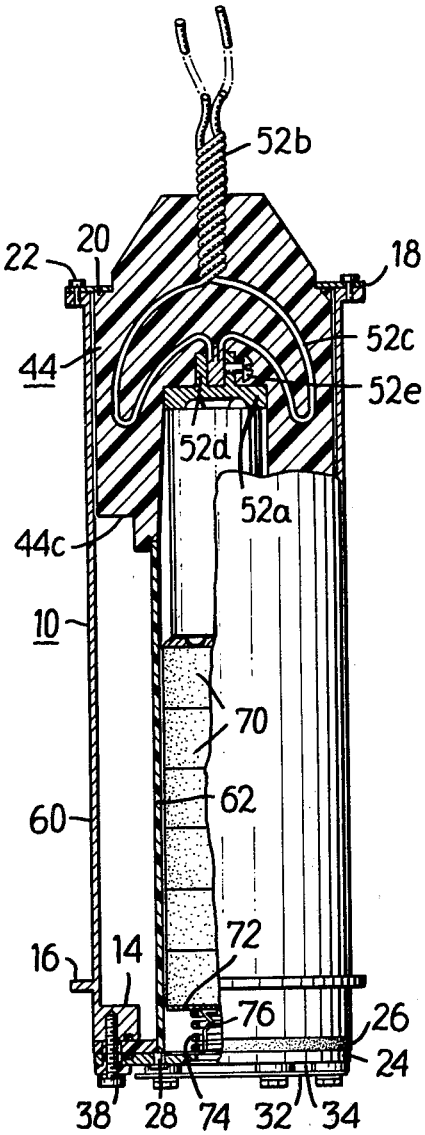
FIG. 10 is a longitudinal sectional view, partly in elevation, of still another modification of the present invention.

FIG. 10 shows a different modification of the present invention capable of being readily connected to the line conductor of electric systems. As shown in FIG. 10, the incoming-line terminal and the shield member are formed of a plurality, in this case two, of lengths of insulated electric wire that is flexible. More specifically, the lengths of the insulated wire has upper portions 52*b* as viewed in FIG. 10 twisted into a rope and lower portions 52*c* radially outwardly curved away from each other and then radially inwardly ascending until the ends thereof are inserted together into a split hollow boss 52*d* disposed on the upper surface as viewed in FIG. 10 of the terminal plate 52*a* at the center and fixed in the boss 52*d* by means of a set screw 52*e*. Thus the lower wire portions 52*c* is in the form of a cross sectional profile of an umbrella.

The lengths of insulated electric wire thus formed and the terminal plate 52*a* with the central boss 52*d* are embedded in the electric insulation block 42 upon the molding thereof. As shown in FIG. 10, the lower terminal portions 52*c* has the lower ends having their positions somewhat lower than the position of the upper end of the discharge gap device 68 and are identical in operation to the annular shield member 54 as above described in conjunction with FIG. 1. The upper twisted portion 52*b* has an upper end portion protruding beyond the upper end of the electric insulation block 42 and terminating at untwisted wire portions.

In other respects the arrangement is identical to that shown in FIG. 5.

The arrangement as shown in FIG. 10 can readily be electrically connected to the line conductor of electric systems by having the untwisted wire portion bent to be hung on the line conductor without the necessity of using any special fittings.

The arrangement of FIG. 10 is advantageous in that a space required for the same to be installed can be far smaller as compared with the prior art practice. Also when hung on the line conductor, the arrangement has no load imposed upon the connection of the lower terminal portions 52c to the terminal plate 52a because the lower termainal portion 52c is embedded in the electric insulation block 42 and in the form of the cross sectional profile of an umbrella.

If desired, the lower terminal portion 52c may be in the form of a cross sectional profile of an inverted cup or in the form of a helix.

From the results of calculations and experiments it has been found that, with satisfactory results, a ratio between the radius of gr of the discharge gap device 66 and the inside radius Ir of the grounded housing 10 or gr/Tr ranges from one-fourth to one-half and is preferably of one-third. Also it has been similarly found that, with satisfactory results, the following dimensional relationships should be held between the electric insulation block 42 and the discharge gap device 66:

$$(CH/gh) = 1 \sim \tfrac{1}{3}$$

and $$(Ch/CH) = 1 \sim \tfrac{1}{3}$$

where

CH = axial length of that portion of the discharge gap device 66 extending from the upper end surface thereof or the end of incoming-line side to the lower end of the insulation block 42 or the end of the ground side thereof.

gh = axial length of the discharge gap device 66.

Ch = axial length of that portion of the discharge gap device extending from the upper end surface to the lower surface of the insulation block 42 defined by the step 42c. Further the preferred values of the rations CH/gh and Ch/CH are of 9/14 and $\tfrac{3}{4}$ respectively.

While the present invention has been illustrated and described in conjunction with several preferred embodiments thereof it is to be understood that numerous changes and modifications may be resorted to without departing from the spirit and scope of the present invention.

What we claim is:

1. A lightning arrester device comprising, in combination, a metallic housing, an arrester element disposed within said metallic housing and including a discharge gap device, an electrically insulative block disposed on the incoming-line side of said metallic housing and shaped to encircle the incoming-line side of said discharge gap device including at least a portion of the lateral surface of the incoming-line side of said discharge gap device while leaving a space between said metallic housing and said arrester element to encircle the ground side of said arrester element, terminal means on the incoming-line side extending through and sealed in said electrically insulative block for connecting with the incoming-line side of said arrester element, and means for forming a hermetic seal between said electric insulation block and said metallic housing, said space defining an electrically insulating space in which said arrester element is disposed and said insulative block portion having a dielectric constant greater than that of said space to reduce in use an electric field density on said discharge gap device.

2. A lightning arrester device as claimed in claim 1 wherein said metallic housing is electrically insulated from said terminal means through said electric insulation block.

3. A lightning arrester device as claimed in claim 1, wherein that surface of said electric insulation block exposed to said insulation space is tilted relative to the longitudinal axis of said arrester element.

4. A lightning arrester device as claimed in claim 1 wherein said electric insulation block includes a portion extending from said metallic housing and tilted relative to the longitudinal axis of the arrester element.

5. A lightning arrester device as claimed in claim 1 wherein said arrester element further comprises a characteristic element, and said electric insulation block encircles at least the incoming-line side of said discharge gap device.

6. A lightning arrester device as claimed in claim 1 wherein said electrically insulation space is filled with an electrically negative gas selected from the group consisting of nitrogen and sulfur hexafluoride.

7. A lightning arrester device as claimed in claim 1 wherein said electric insulation block is formed of an electrically insulating resin.

8. A lightning arrester device as claimed in claim 1 wherein said metallic housing is formed of a metallic material selected from the group consisting of aluminum and iron.

9. A lightning arrester device as claimed in claim 1 wherein said metallic housing is coaxial with said arrester element.

10. A lightning arrester device as claimed in claim 1 wherein said metallic housing is in the form of a cup having an opening closed with said electric insulation block.

11. A lightning arrester device as claimed in claim 1 wherein said electric insulation block is provided on the surface thereof facing said electrically insulating space with a step for improving the distribution of an electric field.

12. A lightning arrester device as claimed in claim 1 wherein said electric insulation block includes a portion extending beyond said metallic housing and having a plurality of circumferential grooves disposed in axially spaced, parallel relationship thereon.

13. A lightning arrester device as claimed in claim 1 wherein a shield member is embedded in said electric insulation block.

14. A lightning arrester device as claimed in claim 13 wherein said shield member is equal in potential to said terminal means.

15. A lightning arrester device as claimed in claim 13 wherein said shield member includes a curved extension running toward the ground side within said electric insulation block.

16. A lightning arrester device as claimed in claim 13 wherein said shield member is formed of a metallic material.

17. A lightning arrester device as claimed in claim 13 wherein at least one metallic electrode is disposed adjacent said shield member to be embedded in said electric insulation block and in electrically insulated relationship with respect to said terminal means, said at least one metallic electrode being electrically led to the exterior of said electric insulation block.

18. A lightning arrester device as claimed in claim 17 wherein said electrode is in the form of a ring encircling said arrester element.

19. A lightning arrester device as claimed in claim 17 wherein said electrode includes an electrical lead having an end extending externally of said electric insulation block.

20. A lightning arrester device as claimed in claim 1 wherein said terminal means on the incoming-line side is formed of an electrically insulated wire.

21. A lightning arrester device as claimed in claim 1 wherein said terminal means on the incoming-line side comprises a flexible electrical conductor including a curved portion within said electric insulation block.

22. A lightning arrester device as claimed in claim 1 wherein said terminal means on the incoming-line side is formed of at least two flexible electrical conductors including respective portions curved in the opposite directions within said electric insulation block.

23. A lightning arrester device as claimed in claim 13 wherein said shield member is of aluminum and said electric insulation block is of an epoxy resin.

24. A lightning arrester device as claimed in claim 13 wherein said shield member includes at least one hole.

25. A lightning arrester device as claimed in claim 1 wherein said electric insulation block includes a portion extending from said metallic housing to form a bushing portion through which said terminal means centrally extends.

26. A lightning arrester device as claimed in claim 13 wherein said shield member is formed integrally with said terminal means.

27. A lightning arrester device as claimed in claim 1 wherein said electric insulation block has disposed on the grounded side thereof a recess into which said arrester element is partly fitted.

28. A lightning arrester device as claimed in claim 1 wherein said metallic housing is formed of a hollow cylindrical portion substantially coaxial with said arrester element and a cover plate attached to the ground side of said cylindrical portion.

29. A lightning arrester device as claimed in claim 1 wherein a hollow electrically insulating cylinder is disposed within said electrically insulating space to abut at both ends against said electric insulation block and said housing respectively, and said arrester elements includes at least one portion inserted into said insulating cylinder.

30. A lightning arrester device as claimed in claim 28 wherein an electrically insulating plate is interposed between said hollow cylindrical portion and said cover plate.

31. A lightning arrester device as claimed in claim 29 wherein said electrically insulating cylinder is of MICARTA (trade mark).

32. A lightning arrester device as claimed in claim 1 wherein said metallic housing is formed of a hollow cylindrical portion substantially coaxial with said arrester element and a cover plate attached to that end of said hollow cylindrical portion disposed on the incoming-line side.

33. A lightning arrester device as claimed in claim 32 wherein said cover plate includes a central opening and wherein said electric insulation block has a bushing portion integral therewith to be extended and sealed through said central opening on said cover plate.

34. A lightning arrester device as claimed in claim 33 wherein said bushing portion is formed of a resin.

35. A lightning arrester device as claimed in claim 33 wherein another shield member is embedded in said electric insulation block so as to partly extend into said bushing portion thereby to alleviate the concentration of an electric field at the inner peripheral edge of said cover plate.

36. A lightning arrester device as claimed in claim 32 wherein a packing is disposed between said hollow cylindrical portion and said cover plate.

37. A lightning arrester device as claimed in claim 33 wherein a packing is disposed between said hollow cylindrical portion and said cover plate and another packing is disposed between said cover plate and said electric insulation block.

38. A lightning arrester device as claimed in claim 29 wherein an electrically insulating space is formed between said metallic housing and said hollow cylindrical portion.

39. A lightning arrester device as claimed in claim 1 wherein said arrester element and said metallic housing have respective radii of gr and Tr satisfying the relationship that a ratio of gr/Tr ranges from one-fourth to one-half.

40. A lightning arrester device as claimed in claim 1 wherein that portion of said arrester element extending from its end of the incoming-line side to the innermost end on the ground side of said electric insulation block has a length of CH satisfying the relationship that ratio of CH/gh ranges from 1 to $\frac{1}{3}$ where gh designates the axial length of said arrester element.

41. A lightning arrester device as claimed in claim 1 wherein that portion of said arrester element extending from its end of the incoming-line side to that end at the highest level on the ground side of said electric insulation block has a length ch satisfying the relationship that a ratio of ch/CH ranges from 1 to $\frac{1}{3}$ where CH designates a length of that portion of said arrester element disposed between its end on the incoming-line side and the innermost end on the grounded side of said electric insulation block.

42. A lightning arrester device as claimed in claim 25, wherein said bushing portion is comprised of a resin.

* * * * *